US005901676A

United States Patent [19]

Edelmayer

[11] Patent Number: 5,901,676

[45] Date of Patent: May 11, 1999

[54] HYDRAULIC LASH COMPENSATOR

[75] Inventor: Thomas C. Edelmayer, Battle Creek, Mich.

[73] Assignee: Eaton Corporation, Cleveland, Ohio

[21] Appl. No.: 08/919,410

[22] Filed: Aug. 28, 1997

[51] Int. Cl.[6] ..... F01L 1/24

[52] U.S. Cl. ..... 123/90.35; 123/90.36; 123/90.43; 123/90.49; 123/90.55

[58] Field of Search ..... 123/90.33, 90.35, 123/90.36, 90.43, 90.46, 90.48, 90.49, 90.52, 90.55, 90.57

[56] References Cited

U.S. PATENT DOCUMENTS

| | | | |
|---|---|---|---|
| 3,314,404 | 4/1967 | Thompson | 123/90.43 |
| 4,481,913 | 11/1984 | Wirth | 123/90.55 |
| 4,584,976 | 4/1986 | Hillebrand | 123/90.55 |
| 4,807,576 | 2/1989 | Sonoda et al. | 123/90.43 |
| 5,445,116 | 8/1995 | Hara | 123/90.43 |
| 5,622,147 | 4/1997 | Edelmayer | 123/90.35 |
| 5,642,694 | 7/1997 | Dura et al. | 123/90.43 |

*Primary Examiner*—Weilun Lo
*Attorney, Agent, or Firm*—L. J. Kasper

[57] ABSTRACT

A hydraulic lash adjuster (130) for an internal combustion engine which includes a body (132) and a plunger (134) of thin-walled construction in which features such as hydraulic fluid collector volumes between the plunger and the body and a check valve seat (174) in the plunger are formed by selectively displaced regions (135,137) of the walls of the body (132). Because of the thin-walled construction of the body (132) and plunger (134), a resilient cap member (161) is in engagement with the upper open end of the body (132) and includes a lip portion in sealing engagement with the outside diameter of the plunger (134), the cap member (161) being rigid enough to help guide the plunger as it reciprocates within the body.

16 Claims, 2 Drawing Sheets

HYDRAULIC LASH COMPENSATOR

BACKGROUND OF THE DISCLOSURE

The present invention relates generally to hydraulic lash compensators (or adjusters), and more particularly to a hydraulic lash adjuster which is of extremely light weight and cost effective construction.

Hydraulic lash adjusters for internal combustion engines have been in use for many years to eliminate clearance, or lash, between engine valve train components under varying operating conditions in order to provide a consistent valve motion and to maintain engine operating efficiency and to reduce noise and wear in the valve train. Hydraulic lash adjusters operate on the principle of transmitting the energy of the valve actuating cam through hydraulic fluid trapped in a pressure chamber behind a plunger. During each revolution of the cam, as the length of the valve actuating components varies due to temperature changes or wear, small quantities of hydraulic fluid are permitted to enter or escape from the pressure chamber and thus effect an adjustment in the position of the plunger, and consequently, an adjustment of the effective total length of the valve train.

The cam operating cycle comprises two distinct events: base circle and valve actuation. The base circle event is characterized by a constant radius between the cam center of rotation and the cam follower during which effectively no motion or cam energy is transmitted. The valve actuation event is characterized by a varying radius between the cam center of rotation and the cam follower which effectively transmits cam energy to open and close an engine valve. During the valve actuation event, a portion of the loads due to the valve spring, the inertia of valve train components, and cylinder pressure are transmitted through the valve train and through the lash adjuster. These loads raise the pressure of the hydraulic fluid within the lash adjuster pressure chamber in proportion to the plunger area, and in current hydraulic lash adjusters, causes some fluid to escape from the pressure chamber. As the fluid escapes, the plunger moves down according to the change in volume of the pressure chamber, shortening the effective length of the valve train. During the base circle event, the lash adjuster plunger spring moves the plunger up such that no clearance or lash exists between valve actuation components.

Hydraulic fluid is drawn into the pressure chamber through the plunger check valve in response to the increased volume of the pressure chamber as the plunger moves up. If the effective length of the valve train shortens during the cam operating cycle, positive lash is created and the lash adjuster extends, moving the plunger to a higher position at the end of the cycle than at the beginning. Inversely, if the effective length of the valve train lengthens during the cam cycle, negative lash is created and the lash adjuster contracts, moving the plunger to a lower position at the end of the cycle than at the beginning. The latter condition typically occurs when valve train components lengthen in response to increased temperature.

In prior art hydraulic lash adjusters the escape of hydraulic fluid from the pressure chamber is between the plunger and the wall of the lash adjuster body. Such escape or "leakdown" is controlled solely by the fit of the plunger within the body. Effective operation of the lash adjuster requires that the leakdown be precisely controlled, and thus, the fit between the plunger and the body must be held to a very close clearance, e.g., between about 0.000200 in. (0.00508 mm) and 0.000230 in. (0.00584 mm). Such close clearances require selective fitting of the plunger to the body, which is an expensive operation.

U.S. Pat. No. 5,622,147, assigned to the assignee of the present invention, and incorporated herein by reference, discloses a hydraulic lash adjuster wherein the fit between the plunger and the body is relatively loose in comparison with prior art designs, but wherein a resilient seal between the plunger and the body is used to maintain a pressure seal between the high and low pressure regions of the lash adjuster. Effective leakdown is obtained by providing a normally open check valve and closely controlling the movement of the check valve between its open and closed positions, wherein during the initial portion of the valve actuation event some hydraulic fluid escapes from the high pressure chamber as the flowing fluid closes the check valve. The plunger then moves downward according to the change in volume of the pressure chamber, thus shortening the effective overall length of the valve train.

The elimination of the need for leakdown between the plunger and the lash adjuster body, and the precision fit required thereby, provides an opportunity to make fundamental changes in the plunger and body structures permitting the use of significantly lighter weight and more economically fabricated components than heretofore considered possible. The present invention addresses this opportunity by providing a lash adjuster body and a plunger which can be fabricated by a cold forming process which produces the parts to essentially net shape requiring little or no additional finishing steps prior to assembly. The thin-walled structure produced by cold forming further permits certain ports and passages, as well as other characteristics required for the function of the lash adjuster, to be formed as part of the cold forming process; whereas, in prior art designs additional machining steps were required to obtain these characteristics.

BRIEF SUMMARY OF THE INVENTION

The present invention thus provides a one-piece plunger having a ball end integrally formed thereon for engagement with a socket formed on a rocker arm or the like, a check valve retaining element formed integrally therewith opposite the ball end, and an oil inlet port formed in the wall of the plunger, which port can also be formed in connection with the cold forming process.

The invention also provides a body which is formed to provide external lands to support the lash adjuster assembly within an engine bore, internal and external oil channels, ports, travel limiting surfaces and spring and check valve locating surfaces, all of which elements can be formed in an integrated sequence of operations in a cold deep drawing process carried out on what is commonly referred to as a transfer press.

The present invention is most advantageously used in connection with a lash adjuster of the type disclosed in the above-incorporated patent, wherein a precision fit is not required between the plunger and the body and wherein seal retaining elements and the like can also be formed by the transfer press.

BRIEF DESCRIPTION OF THE DRAWINGS

Other objects and advantages of the invention will be apparent from the following description when considered in connection with the accompanying drawings, wherein.

DETAILED DESCRIPTION OF THE PREFERRED EMBODIMENT

Figure 1:
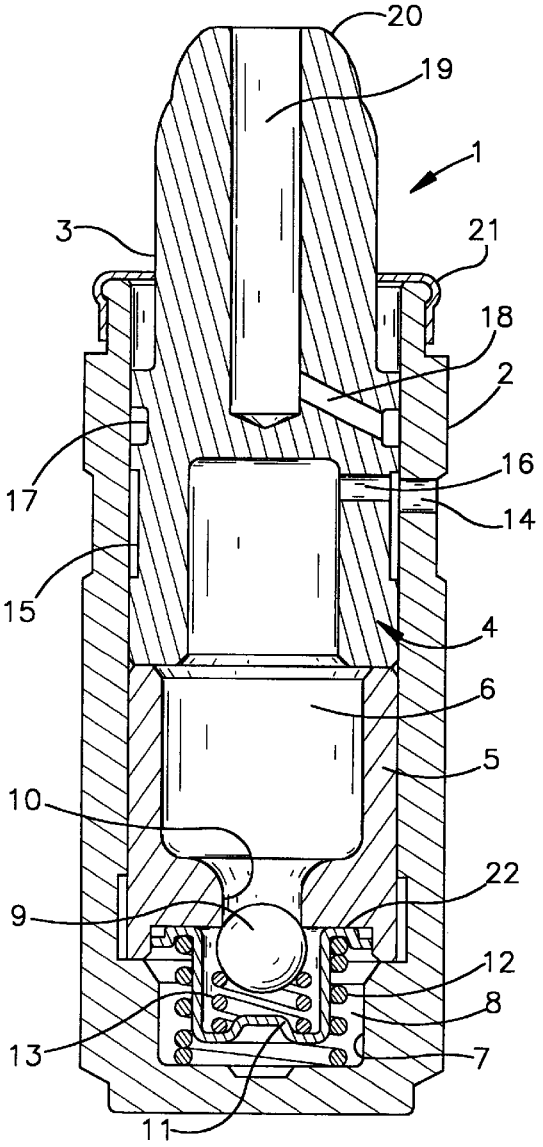
Fig.1 (PRIOR ART)
FIG. 1 is a cross-sectional view of a prior art hydraulic lash adjuster.

Referring to FIG. 1, there is illustrated a prior art lash adjuster 1 having a body 2, a plunger assembly 3 defined by an upper plunger element 4 and a lower plunger element 5. The plunger elements 4 and 5 are received within the body in close fitting relationship and which define a low pressure chamber 6 between them. The bottom of the lower plunger element 5 forms, in cooperation with the end of a reduced diameter portion 7 of the body bore, a high pressure chamber 8. A check valve 9 is provided in the end of a passage 10 which connects the high and low pressure chambers. The check valve, which is shown as a ball but which can be a flat disk or the like, is retained by a cage 11 which is in interference fit with a counterbore 22 formed in the lower plunger element and which provides a seat for a lash adjuster plunger spring 12. In accordance with the most prevalent design practice, a bias spring 13 acting between the bottom of the cage 11 and the check valve 9 biases the check valve into a normally closed position.

An oil entry port 14 opens into the body bore and intersects a collector groove 15 which intersects a radial port 16 in the upper plunger element 4 to supply hydraulic fluid to the chamber 6. A second collector groove 17 and port 18 in the upper plunger element 4 provides metered hydraulic fluid to an axial bore 19 to supply lubricant to a rocker arm (not shown), which engages a modified ball end 20 formed on the end of the upper plunger element 4. Metering is provided by means of a controlled clearance between the plunger and the bore in the area of the land between the port 14 and the collector groove 17. The plunger is retained within the body by means of a cap 21.

In the prior art embodiment shown in FIG. 1, leakdown is controlled by the fit between the body bore and the outside diameter of the bottom plunger element 5, requiring the diametral clearance between these members to be held very precisely, e.g., between 0.000200 in. (0.00508 mm) and 0.000230 in. (0.00584 mm), which can only be achieved by machining the individual parts to extremely close tolerances and selectively pairing the plunger members and the bodies to achieve the desired clearance.

Figure 2:
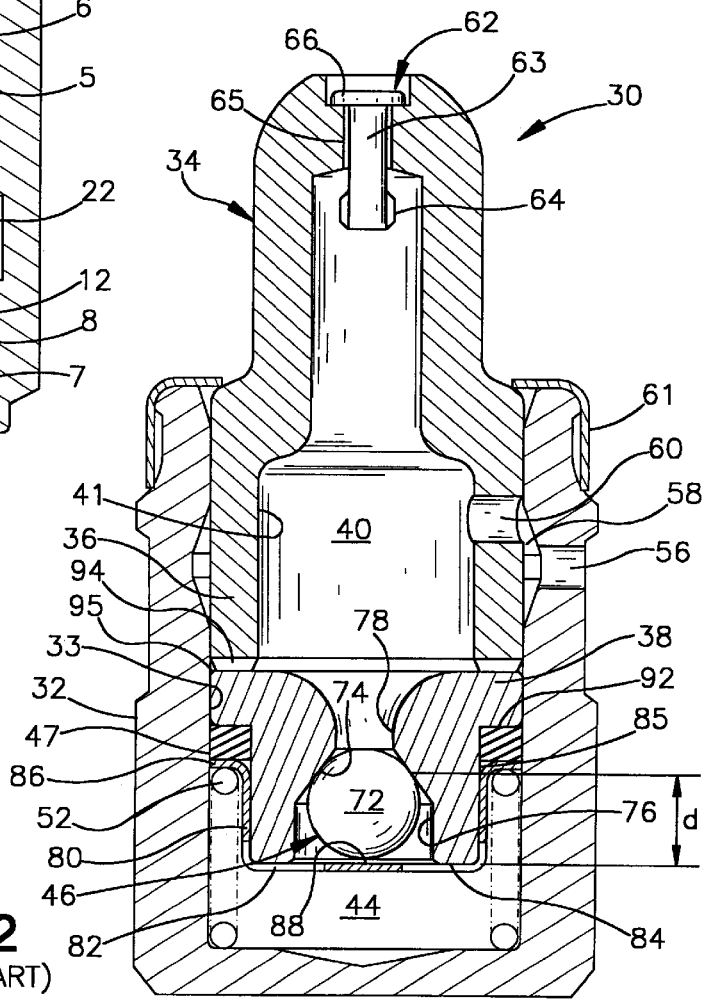
Fig.2 (PRIOR ART)
FIG. 2 is a cross-sectional view of another prior art hydraulic lash adjuster.

Referring now to FIG. 2, there is illustrated another prior art lash adjuster 30 comprising a body 32 having a blind bore 33 formed therein, and a plunger assembly 34 including an upper plunger element 36 and a lower plunger element 38 received in the bore 33. A low pressure chamber or reservoir 40 is defined by a first axial stepped bore 41 formed in the upper plunger element 36, a high pressure chamber 44 is defined between the bottom of the lower plunger element 38 and the bottom of the body bore 33, and a check valve assembly 46 is disposed in the lower plunger element. A seal 47 acts between the lower plunger member and the bore 33, and a plunger spring 52 biases the plunger assembly 34 upward.

In the embodiment illustrated in FIG. 2, hydraulic fluid is supplied to the chamber 40 through a port 56 which opens into the bore 33 and intersects a collector groove 58 which also intersects a port 60 in the upper plunger element opening into the chamber 40. A cap 61 retains the plunger assembly in accordance with normal practice. Metered hydraulic fluid is supplied to the rocker arm by means of a valve 62 which allows a limited flow of fluid outward of the plunger, but which acts as a check valve to prevent the inflow of air in the event of a low or negative pressure condition within the low pressure chamber 40. The valve 62 is in the form of a pin 63 having outwardly extending portions 64 which can be compressed to snap the valve into place through a port 65 formed in the end of the upper plunger, and a head 66 formed thereon to define the check valve.

The check valve assembly 46 comprises a ball 72, a seat 74 which is defined by a surface formed at the intersection of a bore 76 in the bottom of the lower plunger element 38 with a bore 78 connecting the chamber 40 with the bore 76, and retainer 80 which retains the ball within the bore 76. In the illustrative embodiment, the retainer 80 is in the form of a cup having areas 82 cut away to allow hydraulic fluid flow into the chamber 44 and which is retained against the bottom surface 84 of the lower plunger element 38 by means of an interference fit with an area of reduced diameter 85 formed on the lower plunger element. The plunger spring 52 acts against a flange portion 86 of the retainer. In the shown embodiment, the seat 74 is a conical surface, which serves to guide the ball to the seat and thus provides more consistent closing action than would be the case if the seat were defined by an edge. It can be appreciated, however, that the seat could also be formed by an edge defined by the intersection of the bores 76 and 78.

To provide close control of check valve travel, the ball 72 is completely enclosed within the bore 76, as compared with the open construction of the prior art lash adjuster shown in FIG. 1, and the distance "d" between the contact surface of the seat 74 and surface 88 of the retainer is set, in relation to the diameter of the ball 72, at a predetermined value corresponding to a desired effective leakdown rate. While somewhat precise dimensioning is required to minimize variation of the distance "d", the only critical dimension in production is the location of the seat 74 relative to the surface 84, which is easily controlled and which does not involve the degree of precision or select fitting required by the prior art lash adjuster shown in FIG. 1. Other critical dimensions are the ball size and the flatness of the surfaces 84 and 88; however, extremely precisely dimensioned balls are essentially a commodity, and the flatness of the above components is easily controlled.

The seal 47 is received over the reduced diameter portion 85 of the lower plunger element 38 and is retained axially by a shoulder 92 defined by the intersection between the diameter 85 and the outside diameter of the plunger element 38 and by the flange 86 of the retainer 80.

In practice, lash adjusters are filled with hydraulic fluid at assembly so that they will not be completely dry at initial startup of the engine. There is thus the possibility that the initial fluid fill can be inadvertently lost due to the relatively large clearance between the plunger and the body and between the unenergized seal and the body. Accordingly, means can be provided to recirculate hydraulic fluid from the high pressure chamber which may escape past the seal back into the low pressure chamber. In the embodiment shown in FIG. 2, a low resistance recirculation path is provided by radial grooves 94 formed in the bottom of the upper plunger element 36 (which can alternatively be formed in the lower plunger element) communicating with a collector groove defined by a chamfer 95 formed at the bottom of the upper plunger element (which chamfer can also be formed in the lower plunger element).

FIG. 3—Invention

Figure 3:
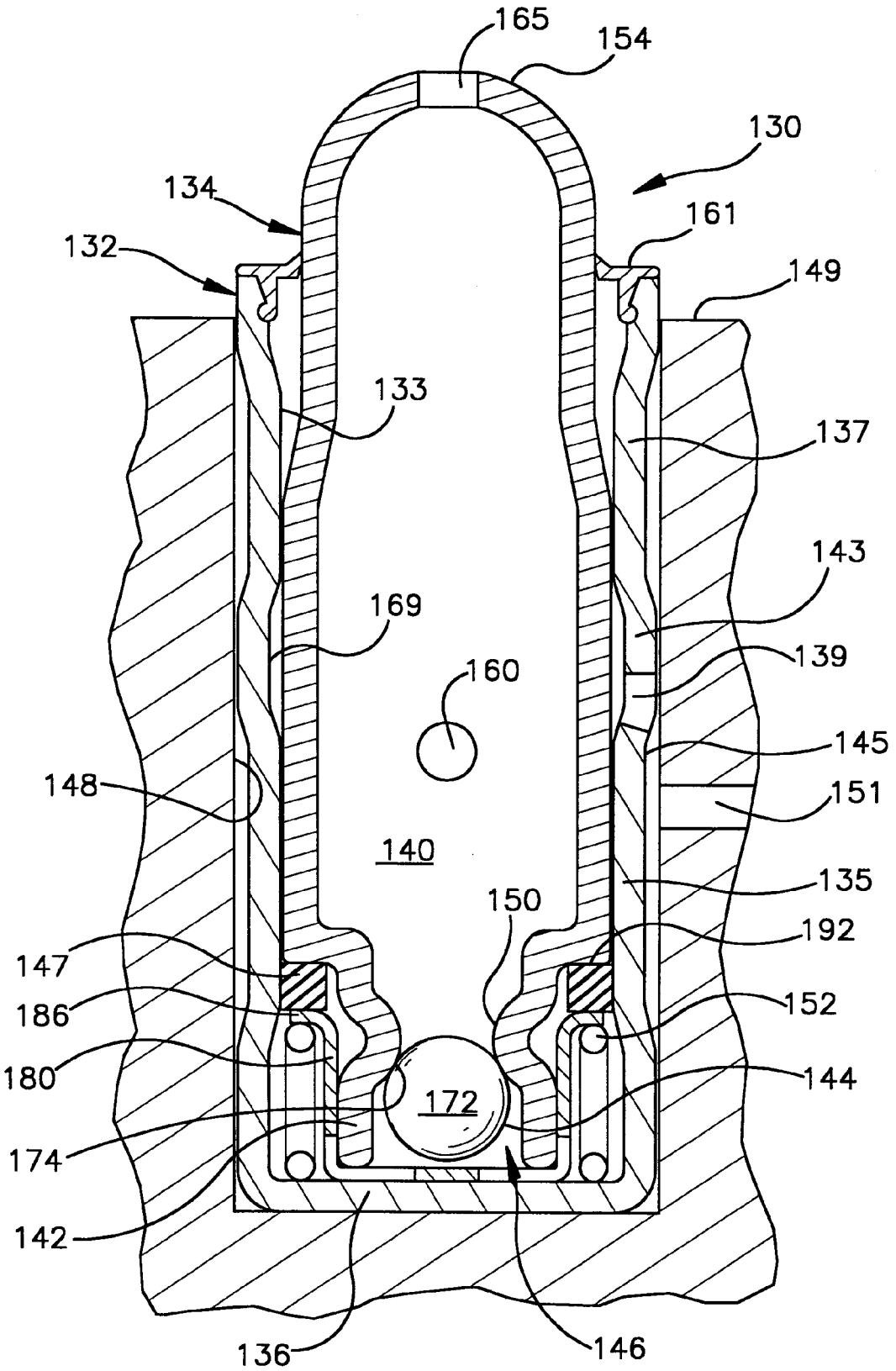
FIG. 3 is a cross-sectional view of a lash adjuster incorporating the present invention.

Referring to FIG. 3, a lash adjuster 130 in accordance with the invention comprises a generally cylindrical body 132 which is closed at one end and open at the other, a cylindrical plunger 134 received within a bore 133 formed in the body 132, a plunger spring 152 acting between the closed end of the body and the plunger, and a check valve assembly 146 received at the lower end of the plunger. In a preferred embodiment of the invention, the body 132 and plunger 134 are formed of steel of sufficiently thin wall section to permit their fabrication by a cold forming process, and more specifically, by means of a deep drawing process in which a sheet metal blank is subjected to a plurality of cold drawing steps in a transfer press wherein mandrels of decreasing diameter and increasing length are sequentially engaged with the blank to draw the blank into an elongated cylindrical shape. Secondary processes such as groove forming, diametric construction and hole piercing can also be carried out within the transfer press.

The body 132 is formed as a single piece cup having a flat closed end 136, a first indented region 135 formed adjacent the closed end, a second indented region 137 formed adjacent the open end and axially spaced from the first indented region, and an oil inlet port 139 formed in a full-diameter region 143 between the first and second indented regions 135 and 137. The oil inlet port 139 opens into an annular volume 145 defined between the indented region 135 and a bore 148 formed in the head 149 of the engine in which the lash adjuster is installed. The annular volume 145 is also in communication with an engine oil supply port 151 formed in the head 149. It should be understood, however, that the present invention is not limited to use in a lash adjuster of the type in which oil is supplied under pressure from the engine. The invention may also be used in lash adjusters of both the "self-contained" type and the "gravity feed" type, both of which are well known to those skilled in the art.

The plunger 134 is an inverted cup formed with a domed end 154 which defines a ball engageable with a socket formed in a rocker arm (not shown) in the engine valve train, and an open end which receives the check valve assembly 146. A port 165 is formed in the domed end to direct hydraulic fluid to lubricate the interface between the plunger and the rocker arm. A valve such as valve 62 shown in FIG. 2 may also be provided in certain applications. A port 160 is formed in the wall of the plunger 134 and opens into an annular volume 169 defined between the indented regions 135 and 137.

The open end of the plunger is cold formed to define a low pressure chamber 140 above the check valve, a high pressure chamber 144 below the check valve, and a seat 174 for the check valve assembly 146. The open end of the plunger also provides retention for the check valve and for a dynamic seal 147 acting between the body and the plunger. More specifically, a region of reduced diameter 142 is formed at the open end of the plunger and an indentation 150 is formed in this region to define the valve seat 174.

The check valve assembly 146 comprises a check ball 172, the seat 174 and a retainer 180 which is received in interference fit over the reduced diameter region 142. Plunger spring 152 acts between the closed end 136 of the body 134 and a flange 186 formed on the retainer 180, the flange, along with a shoulder 192 defined between the fill and reduced diameter regions of the plunger, also serving to retain the seal 147. It should be understood, however, that the invention is not limited to a lash adjuster of the type having the seal 147, wherein all leakdown flow is past the check valve assembly 146. Instead, the invention could be used in a lash adjuster of the type relying upon the traditional leakdown clearance between the body and the plunger, to provide the leakdown flow.

A resilient cap 161 which is retained by a groove formed in the body 132 and which includes a lip in contact with the plunger 134 can be provided to retain the plunger within the body prior to installation in an engine, and to prevent an excessive leakage of fluid between the body and the plunger. Preferably, the resilient cap 161 is formed of a resilient material, such as a hard plastic or a rubber. Thus, the lip of the resilient cap 161 is able to "follow" the outside diameter of the plunger 134 well enough to seal fairly effectively, while being rigid enough to help guide the plunger 134 within the body 132. This latter function is significant in the case of the present invention in which both the body and the plunger comprise metal stampings, for which the diametral tolerance may not be held as closely as for prior art, machined body and plunger sets.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

I claim:

1. A hydraulic lash adjuster for an internal combustion engine comprising a body received in a bore formed in said engine, said body being formed as a cup member having a cylindrical side wall and a closed end wall; a plunger slidingly received within said body; a pressure chamber formed between said closed end wall and said plunger; a fluid chamber within said plunger; a supply of hydraulic fluid within said fluid chamber; a valve opening in said plunger providing fluid communication between said fluid chamber and said pressure chamber; a check valve for selectively opening or closing said valve opening in response to the pressure difference between said fluid chamber and said pressure chamber; spring means acting between the closed end wall of said body and said plunger normally urging said plunger outward of said body; and means formed in at least one of said body and said plunger for directing hydraulic fluid from a source into said fluid chamber; characterized by:

(a) the cylindrical wall of said body having a first diameter engaged with its receiving bore and a second diameter engaged with said plunger, said second diameter being defined by inwardly displaced regions of said cylindrical wall spaced apart along the longitudinal axis of said body; and (b) the cylindrical wall of said body is displaced inwardly in first and second spaced apart regions along said wall, said regions defining first and second annular volumes between said engine bore and said body and a third annular volume between said body and said plunger, said third annular volume being located axially between said first and second annular volumes.

2. A hydraulic lash adjuster as claimed in claim 1, in which a resilient seal ring acts between said body and said plunger.

3. A hydraulic lash adjuster as claimed in claim 1 in which said means for directing hydraulic fluid comprises a port formed in said body in the region between said first and second inwardly displaced regions and in communication with one of said first or second annular volumes and with said third annular volume, and a port formed in said plunger in communication with said third annular volume and with said fluid chamber.

4. A hydraulic lash adjuster as claimed in claim 1, in which said plunger comprises a cup member having its closed end extending outwardly of said body and wherein said valve opening is defined by a first inwardly displaced region of the wall of said plunger adjacent the open end thereof, said valve opening including a valve seat defined by a second inwardly displaced region of said first inwardly displaced region of said plunger.

5. A hydraulic lash adjuster as claimed in claim 4, in which said plunger comprises a metal stamping, and includes a ball plunger portion formed integrally therewith, and said body comprises a metal stamping, including said closed end wall.

6. A hydraulic lash adjuster as claimed in claim 5, in which a retaining means comprises a cup member received over the bottom of said plunger and having an outwardly extending flange formed thereon, and said spring means comprises a coil spring acting between said closed end wall and said flange.

7. A hydraulic lash adjuster as claimed in claim 2 including a portion of reduced diameter extending upward from the bottom of said plunger to define a shoulder at the intersection of said reduced diameter with a full diameter of the plunger, said retainer being received over said reduced diameter, and said seal ring being received over said reduced diameter portion between said shoulder and the flange on said retainer.

8. A hydraulic lash adjuster for an internal combustion engine comprising a body received in a bore formed in said engine, said body being formed as a cup member having a cylindrical side wall and a closed end wall; a plunger assembly slidingly received within said body and including a leakdown plunger; a pressure chamber formed between said closed end wall and said leakdown plunger; a fluid chamber within said leakdown plunger; a supply of hydraulic fluid within said fluid chamber; a valve opening in said leakdown plunger providing fluid communication between said fluid chamber and said pressure chamber; a check valve for selectively opening or closing said valve opening in response to the pressure difference between said fluid chamber and said pressure chamber; spring means acting between the closed end wall of said body and said leakdown plunger normally urging said plunger outward of said body; and means for directing hydraulic fluid from a source into said fluid chamber; characterized by:

(a) said valve opening is defined by a first inwardly displaced region of the wall of said leakdown plunger adjacent the open end thereof, said valve opening including a valve seat defined by a second inwardly displaced region of said first inwardly displaced region of said plunger.

9. A hydraulic lash adjuster as claimed in claim 8, in which said leakdown plunger comprises a metal stamping, and includes a ball plunger portion formed integrally therewith, and said body comprises a metal stamping, including said closed end wall.

10. A hydraulic lash adjuster as claimed in claim 8, in which a resilient seal ring acts between said body and said plunger, and said body comprises a metal stamping, including said closed end wall.

11. A hydraulic lash adjuster as claimed in claim 10, in which a retaining means comprises a cup member received over the bottom of said plunger and having an outwardly extending flange formed thereon, and said spring means comprises a coil spring acting between said closed end wall and said flange.

12. A hydraulic lash adjuster as claimed in claim 11 including a portion of reduced diameter extending upward from the bottom of said leakdown plunger to define a shoulder at the intersection of said reduced diameter with a full diameter of the plunger, said retainer being received over said reduced diameter, and said seal ring being received over said reduced diameter portion between said shoulder and the flange on said retainer.

13. A hydraulic lash adjuster for an internal combustion engine comprising a body received in a bore formed in said engine, said body being formed as a cup member having a cylindrical side wall and a closed end wall; a plunger slidingly received within said body; a pressure chamber formed between said closed end wall and said plunger; a fluid chamber within said plunger; a supply of hydraulic fluid within said fluid chamber; a valve opening in said plunger providing fluid communication between said fluid chamber and said pressure chamber; a check valve for selectively opening or closing said valve opening in response to the pressure difference between said fluid chamber and said pressure chamber; spring means acting between the closed end wall of said body and said plunger normally urging said plunger outward of said body; and means formed in at least one of said body and said plunger for directing hydraulic fluid from a source into said fluid chamber; characterized by:

(a) the cylindrical wall of said body comprising a thin, generally uniform wall formed by deep drawing a sheet metal blank;

(b) the cylindrical wall of said body having a first diameter engaged with its receiving bore and a second diameter engaged with said plunger, said second diameter being defined by inwardly displaced regions of said cylindrical wall spaced apart along the longitudinal axis of said body.

14. A hydraulic lash adjuster as claimed in claim 13 in which the cylindrical wall of said body is formed by means of a deep drawing process comprising a plurality of cold drawing steps.

15. A hydraulic lash adjuster as claimed in claim 13 in which said plunger comprises a deep drawn, stamped metal member, and a resilient cap member is in engagement with an upper end of said cup-shaped body, opposite said closed end wall, said cap member comprising a resilient material and including an inwardly-extending lip portion in sealing engagement with an outside diameter of said plunger.

16. A hydraulic lash adjuster as claimed in claim 15, characterized by said resilient cap member comprising a material having sufficient rigidity to help guide said plunger as it reciprocates within said body.

* * * * *